US007712388B2

(12) United States Patent
Andoh

(10) Patent No.: US 7,712,388 B2
(45) Date of Patent: May 11, 2010

(54) STARTER WITH OVERRUNNING CLUTCH

(75) Inventor: Kazuhiro Andoh, Okazaki (JP)

(73) Assignee: Denso Corporation, Kariya (JP)

( * ) Notice: Subject to any disclaimer, the term of this patent is extended or adjusted under 35 U.S.C. 154(b) by 1180 days.

(21) Appl. No.: 11/304,541

(22) Filed: Dec. 16, 2005

(65) Prior Publication Data

US 2006/0144177 A1 Jul. 6, 2006

(30) Foreign Application Priority Data

Dec. 20, 2004 (JP) ..... 2004-368426

(51) Int. Cl.
*F02N 15/02* (2006.01)
*F02N 15/06* (2006.01)
*F02N 15/04* (2006.01)
*F02N 15/00* (2006.01)

(52) U.S. Cl. ..... 74/7 C; 74/7 A; 74/6

(58) Field of Classification Search ..... 74/6, 74/7 A, 7 C; 403/359.1
See application file for complete search history.

(56) References Cited

U.S. PATENT DOCUMENTS

| | | | | |
|---|---|---|---|---|
| 4,831,895 | A * | 5/1989 | Tanaka et al. | 475/347 |
| 5,067,357 | A | 11/1991 | Isozumi | |
| 5,432,384 | A * | 7/1995 | Isozumi et al. | 290/48 |
| 5,857,380 | A * | 1/1999 | Kajino et al. | 74/7 E |
| 6,389,914 | B1 * | 5/2002 | Hiruma et al. | 74/7 R |
| 2002/0069710 | A1 | 6/2002 | Haruno et al. | |
| 2004/0051319 | A1 | 3/2004 | Okumoto et al. | |

FOREIGN PATENT DOCUMENTS

| | | |
|---|---|---|
| JP | A-03-078566 | 4/1991 |
| JP | A-07-054742 | 2/1995 |
| JP | B2 7-37786 | 4/1995 |
| JP | A-2001-065587 | 3/2001 |
| JP | A-2002-180936 | 6/2002 |
| JP | A-2003-072308 | 3/2003 |
| JP | A-2004-100646 | 4/2004 |

OTHER PUBLICATIONS

Avallone et al., Marks' Standard Handbook for Mechanical Engineers, 10th Ed. 1996, pp. 8-33, 8-34.*
Translated Japanese Office Action for Japanese Patent Application No. 2004-368426, Dated Jan. 6, 2009.

* cited by examiner

*Primary Examiner*—Thomas R Hannon
*Assistant Examiner*—Justin Krause
(74) *Attorney, Agent, or Firm*—Oliff & Berridge, PLC

(57) ABSTRACT

A starter includes a drive shaft having an outer periphery formed with shaft splines through which a drive power is transmitted from a starter motor, an overrunning clutch, having an inner periphery formed with barrel splines engageable with the shaft splines, which is axially moveable with respect to the drive shaft and plays a role as one-way clutch, and a pinion gear integrally disposed on the overrunning clutch to be movable into or out of meshing engagement with a ring gear of an internal combustion engine. A radial clearance between a tooth top of each shaft spline and a tooth bottom of each barrel spline is set to be less than a backlash between each shaft spline and each barrel spline.

12 Claims, 3 Drawing Sheets

STARTER WITH OVERRUNNING CLUTCH

CROSS REFERENCE TO RELATED APPLICATION

The present application relates to and incorporates by reference Japanese Patent application No. 2004-368426 filed on Dec. 20, 2004.

BACKGROUND OF THE INVENTION

1. Technical Field of the Invention

The present invention relates to starters for starting up internal combustion engines mounted on vehicles and, more particularly, to a starter having an overrunning clutch.

2. Related Art

In normal practice, a starter starts up an internal combustion engine of a vehicle when supplied with electric power from an on-vehicle battery to be rotated. As disclosed in Japanese Patent Laid-open (unexamined) Patent Publication No. 7-37786, one type of such a starter includes one that has an overrunning clutch. Such a starter includes a motor (starter motor), a drive shaft having an outer periphery formed with helical shaft splines through which a drive power is transmitted from the starter motor, an overrunning clutch with an inner periphery formed with helical bore splines in mesh with the helical shaft splines and moveable in an axial direction with respect to the drive shaft while serving as one-way clutch, and a pinion gear integrally disposed on the overrunning clutch and operative to engage with and disengage from a ring gear of the internal combustion engine. Thus, the drive shaft, through which the drive power is transmitted from the starter motor, and the overrunning clutch are held in spline coupling.

By the way, looseness (clearance) is present between both splines in a radial and circumferential direction. Therefore, a probability occurs for the overrunning clutch to incline with respect to the drive shaft. In particular, under circumstances where an ignition switch is turned on once while, subsequently, the ignition switch is turned off, before the internal combustion starts up, and turned on again, inertial rotation of the starter motor causes the pinion gear to mesh with the ring gear of the internal combustion engine with the pinion gear remaining under rotation. This results in rapid stop of rotation of the pinion gear. In this case, spline-coupling portions between the drive shaft and the overrunning clutch encounter undue impacts to cause the overrunning clutch and the drive shaft to incline with respect to each other.

As a result of the occurrence of such inclinations of the overrunning clutch and the drive shaft, the spline-coupling portions have surfaces in local contact. Accordingly, this results in undue surface pressures with a fear of the occurrence of adhesion between contact areas of both splines.

SUMMARY OF THE INVENTION

The present invention has been completed with the above issues in mind and has an object to provide a starter that is able to restrict splines of a drive shaft and an overrunning clutch from inclining with respect to each other to preclude the occurrence of adhesion.

With one embodiment according to the present invention, a starter includes a drive shaft having an outer periphery formed with shaft splines through which a drive power is transmitted from a starter motor, an overrunning clutch, having an inner periphery formed with barrel splines engageable with the shaft splines, which is axially moveable with respect to the drive shaft and plays a role as one-way clutch, and a pinion gear integrally disposed on the overrunning clutch and moveable into or out of meshing engagement with a ring gear of an internal combustion engine. A radial clearance between a tooth top of each shaft spline and a tooth bottom of each barrel spline is set to be less than a backlash between each shaft spline and each barrel spline.

Preferably, the drive shaft has an outer periphery formed with a protruding axial travel stopper; the overrunning clutch is formed with an inner bore whose inner diameter is greater than an outer circumferential diameter of the axial travel stopper; the barrel splines of the overrunning clutch have axial one ends operative to be brought into abutting engagement with the axial travel stopper; and a clearance in a radial direction between the axial travel stopper and the inner bore is set to be less than the backlash.

Still preferably, when the axial one ends of the barrel splines are brought into abutting engagement with the axial travel stopper, an axial distance between the axial travel stopper and, among meshing areas between the shaft splines and the barrel splines, the axial other ends of the barrel splines is set to be greater than an axially meshing distance between the shaft splines and the barrel splines.

It is also preferred that the drive shaft is rotatably supported by a support member, which is directly or indirectly and integrally fixed to a housing, on a side closer to the pinion gear in an axial direction thereof.

DETAILED DESCRIPTION OF PREFERRED EMBODIMENTS

Figure 1:
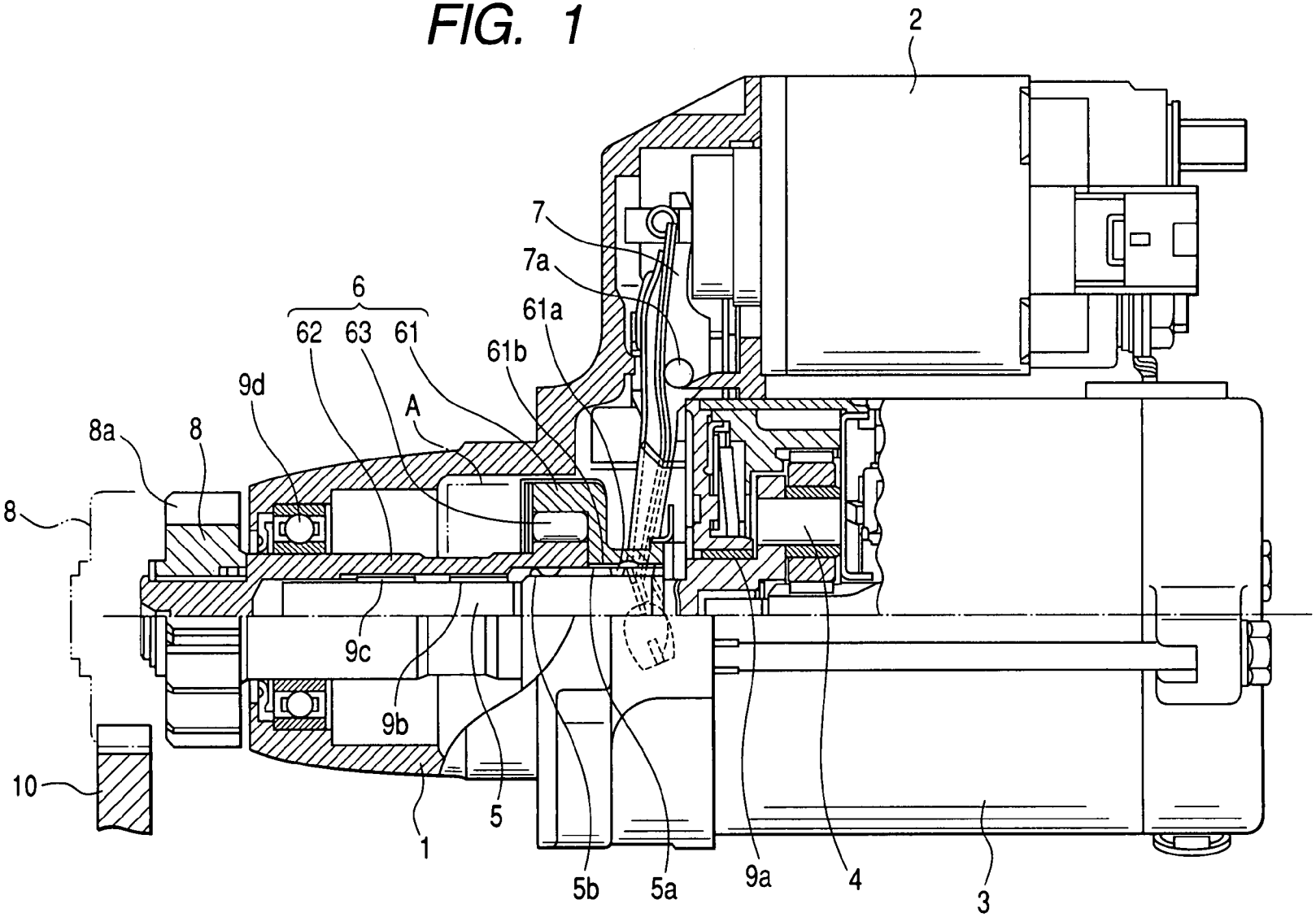
FIG. 1 is a cross sectional view, taken along an axial direction, showing a starter of one embodiment according to the present invention.
Figure 2:
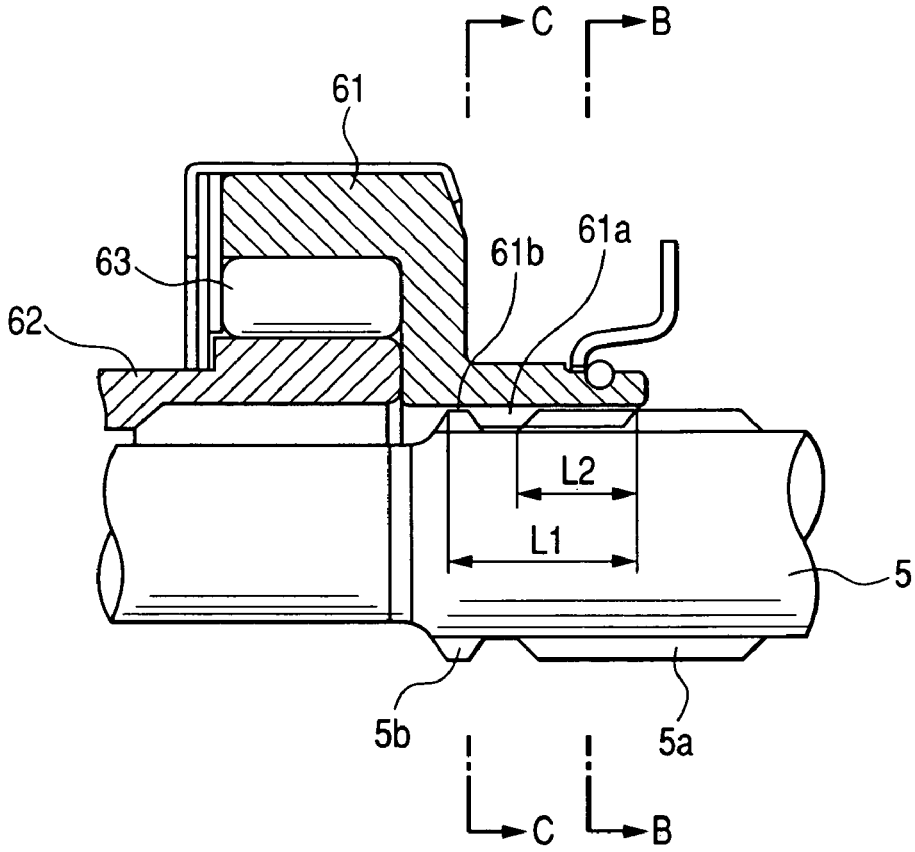
FIG. 2 is an enlarged view of a section "A" in FIG. 1 with an overrunning clutch, shown in FIG. 1, remaining under a forward state.

Referring to FIGS. 1 and 2, a starter of one embodiment according to the present invention will now be described.

As shown in FIG. 1, the starter of the present embodiment is comprised of a housing 1, a magnet switch 2, a starter motor 3, a gear reduction unit 4, a drive shaft 5, an overrunning clutch 6, a lever 7 and a pinion gear 8. The starter plays a role as a device for rotatably driving a ring gear 10 of an internal combustion engine when an ignition switch is tuned on and the pinion gear 8 is shifted leftward in FIG. 1 to be brought into meshing engagement with the ring gear 10.

Also, for the purpose of providing an ease of description, a direction in which the pinion gear 8 is brought into meshing engagement with the ring gear 10, that is, a leftward direction in FIG. 1 is referred to as a forward drive direction and a direction in which the pinion gear 8 is brought out of meshing engagement from the ring gear 10, that is, a rightward direction is referred to as a retracting direction.

The housing 1 is fixedly mounted onto a vehicle body. The magnet switch 2 and the starter motor 3 are fixedly mounted on the housing 1, which accommodates therein the gear reduction unit 4, the drive shaft 5, the overrunning clutch 6 and the lever 7 that are fixedly mounted.

The magnet switch 2, composed of a solenoid coil, is fixedly is mounted on the housing 1 at an upper area thereof in FIG. 1. The magnet switch 2 includes a pull-in coil and a holding coil, wound on a frame fixedly mounted on the housing 1, and a plunger moveable in an axial direction (in a lateral direction in FIG. 1) with respect to the frame. The plunger of the magnet switch 2 is attracted, when the pull-in coil and the holding coil are supplied with electric current, to move in the retracting direction (rightward in FIG. 1). Also, a left end (a left area in FIG. 1) of the plunger of the magnet switch 2 protrudes from the frame.

The starter motor 3, composed of, for instance, a DC motor, is fixedly mounted to the housing 1 in parallel to the magnet switch 2. More particularly, the starter motor 3 has a yoke, fixedly mounted in the housing 1, and an armature rotatably supported by the yoke.

The gear reduction unit 4, composed of, for instance, a planetary gear set, is disposed in the housing 1 in a coaxial relationship with the starter motor 3. The gear reduction unit 4 is coupled to the armature of the starter motor 3. That is, the gear reduction unit 4 serves to reduce a rotational speed of the armature of the starter motor 3. More particularly, the gear reduction unit 4 has a sun gear, connected to the armature of the starter motor 3, a ring gear connected to the housing 1, and a carrier that plays a role as an output shaft.

The drive shaft 5 is disposed in the housing 1 in a coaxial relationship with the starter motor 3 and the gear reduction unit 4. The drive shaft 5 is integrally fixed onto the carrier of the gear reduction unit 4 and rotatably supported by the housing 1 by means of a bearing 9*a*. That is, the drive shaft 5 serves to transfer a drive power of the starter motor 3. In addition, the drive shaft is rotatably supported by an inner periphery of a clutch inner 62 of the overrunning clutch 6, described below, by means of bearings 9*b* and 9*c*.

Figure 3:
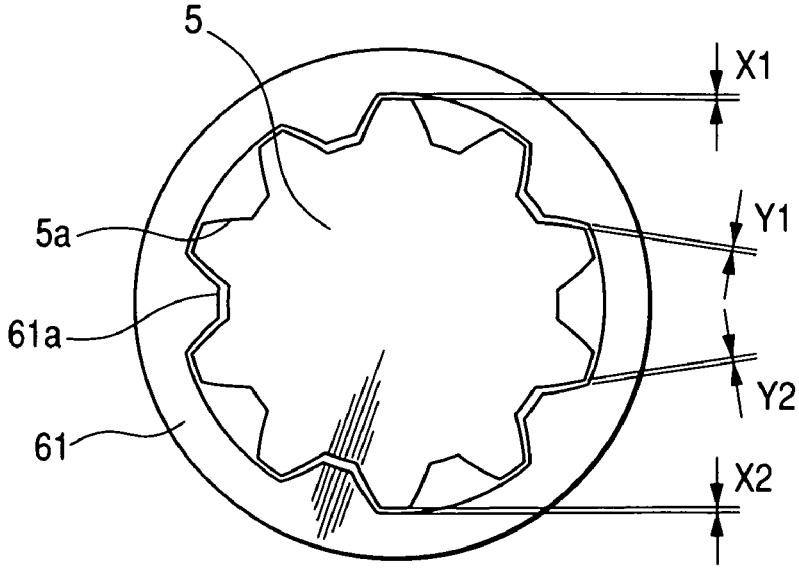
FIG. 3 is a cross-sectional view, taken on line B-B of FIG. 2, showing shaft splines and barrel splines held in meshing engagement.

Further, the drive shaft 5 has an outer periphery formed with ten helical-shaped shaft splines 5*a* on a substantially central area in an axial direction as shown in FIG. 3. In addition, the outer periphery of the drive shaft 5 has a forward end (at a leftward area in FIG. 1) formed with stoppers (axial travel stop member) 5*b* at a position spaced from the shaft splines Sa with a slight gap in an axial direction. Each stopper 5*b* has a substantially trapezoid shape in cross section, taken along an axial direction, as shown in FIGS. 1 and 2. Moreover, the stoppers 5*b* include five protrusions, which are equidistantly formed along a circumferential direction, as viewed in cross section taken along a radial direction in FIG. 4. More particularly, a circumferential width between adjacent stoppers 5*b* takes the form of a shape in conformity to a value equivalent to the two shaft splines 5*a*. That is, a circumferential window width (a circumferential distance between adjacent protrusions) between the adjacent stoppers 5*b* has the same width as that (a circumferential distance between adjacent teeth) between adjacent shaft splines 5*a*.

The circumferential window portion of the adjacent stoppers 5*b* is formed in the same phase as that of a circumferential window portion between the shaft splines 5*a* at areas facing the forward drive direction. The circumferential window portion between the stoppers 5*b* is formed to allow the overrunning clutch 6, describe below, to be inserted onto the drive shaft 5 from an area, facing the forward drive direction, to the other area facing the retracting direction. Tooth tops of the shaft splines 5*a* and outer peripheral surfaces of the stoppers 5*b* are grounded on the same sequence. That is, the tooth tops of the shaft splines 5*a* and outer circumferential peripheries of the stoppers 5*b* are formed to fall in the same diameter.

The overrunning clutch 6, composed of a bottomed cylinder, is disposed in the housing 1 in coaxial relationship with the drive shaft 5. The overrunning clutch 6 has a cylindrical portion whose outer periphery is rotatably supported with the housing 1 by means of a bearing 9*d*. Further, the cylindrical portion of the overrunning clutch 6 has an inner periphery in which bearings 9*b*, 9*c* are supported to allow the drive shaft 5 to axially move and rotate within the overrunning clutch 6. The overrunning clutch 6 takes the form of a one-way clutch that allows rotation in one direction. In particular, the overrunning clutch 6 is comprised of a clutch outer 61, a clutch inner 62 and a roller 63.

The clutch outer 61 takes the form of a substantially cylindrical shape as shown in FIGS. 1 and 2 and has an inner periphery formed with five helical-shaped barrel splines 61*a* that are brought into meshing engagement with the shaft splines 5*a* as shown in FIG. 3. That is, the barrel splines 61*a* are brought into meshing engagement with the shaft splines 5*a* in an alternate fashion. Moreover, the barrel splines 61*a* are disposed in areas, formed with the stoppers 5*b*, among the areas formed with the shaft splines 5*a*. In other word, the barrel splines 61*a* are disposed in the areas corresponding to the circumferential window portions of the stoppers 5*b*, respectively.

Accordingly, with the clutch outer 61 moved in the forward drive direction, distal ends, facing the forward drive direction, of the barrel splines 61*a* are brought into abutting engagement with the stoppers 5*b*, respectively. Also, an inner periphery of the clutch outer 61 has an inner bore 61*b* formed at a position adjacent to the barrel splines 61*a* in the forward drive direction. The inner bore 61*b* is formed in the same diameter as an inner diameter of the tooth bottom of each barrel spline 61*a*. That is, the inner bore 61*b* is formed to be contiguous with the tooth bottoms of the barrel splines 61*a*.

A tooth bottom diameter of each barrel spline 61*a* and the inner diameter of the inner bore 61*b* take the form of diameters slightly larger than a tooth top diameter of each shaft spline 5*a* and the outer circumferential diameter of the stoppers 5*b*. Also, details of dimensional relationships among the shaft splines 5*a*, the stoppers 5*b*, the barrel splines 61*a* and the inner bore 61*b* are described below.

With the clutch outer 61 moved in the forward drive direction with respect to the drive shaft 5, the clutch outer 61 takes a positional relationship as shown in FIG. 2. More particularly, the forward ends of the barrel splines 6*a* are brought into abutting engagement with the stoppers 5*b*. In this respect, a distance (axial distance) L1 between end faces, facing the forward drive direction, among the outer peripheries of the stoppers 5*b* and end faces, facing the retracting direction, of meshing areas between the shaft splines 5*a* and the barrel splines 61*a* is adjusted to fall in a value longer than a distance L2 in which the shaft splines 5*a* and the barrel splines 61*a* are held in meshing engagement.

As shown in FIG. 1, the clutch inner 62 takes the form of a substantially bottomed cylinder, whose open end engages the clutch outer 61 by means of rollers 63 for rotating capability in one direction. Further, the clutch inner 62 has an outer peripheral surface whose end is rotatably supported with the housing 1 by means of a bearing 9*d* at a position far from the rollers 63 in the forward drive direction. Furthermore, an inner peripheral surface of the clutch inner 62 supports the drive shaft 5 by means of the bearings 9*b*, 9*c* for relatively rotating capability and axially moving capability. A forward end portion of the clutch inner 62 protrudes outward of the housing 1.

The lever 7 has a substantially central area 7*a* that is fixedly mounted in the housing 1. That is, the lever 7 is moved in rocking motion about the position 7*a* fixedly mounted to the housing 1. The lever 7 has one end connected to a left end of the plunger of the magnet switch 3 for rotating capability in a direction perpendicular to an axis of the magnet switch 2. On the other hand, the other end of the lever 7 is connected to the clutch outer 61 at an outer peripheral surface thereof for rotating capability in a direction perpendicular to an axis of the clutch outer 61. That is, the lever 7 has a function to allow the overrunning clutch 6 to operate in association with the operation of the plunger of the magnet switch 2.

The pinion gear 8 has an outer periphery formed with gear teeth 8*a* operative to be brought into or out of meshing engagement with the ring gear 10 of the internal combustion engine and is integrally fixed to a forward end of the clutch inner 62.

Figure 4:
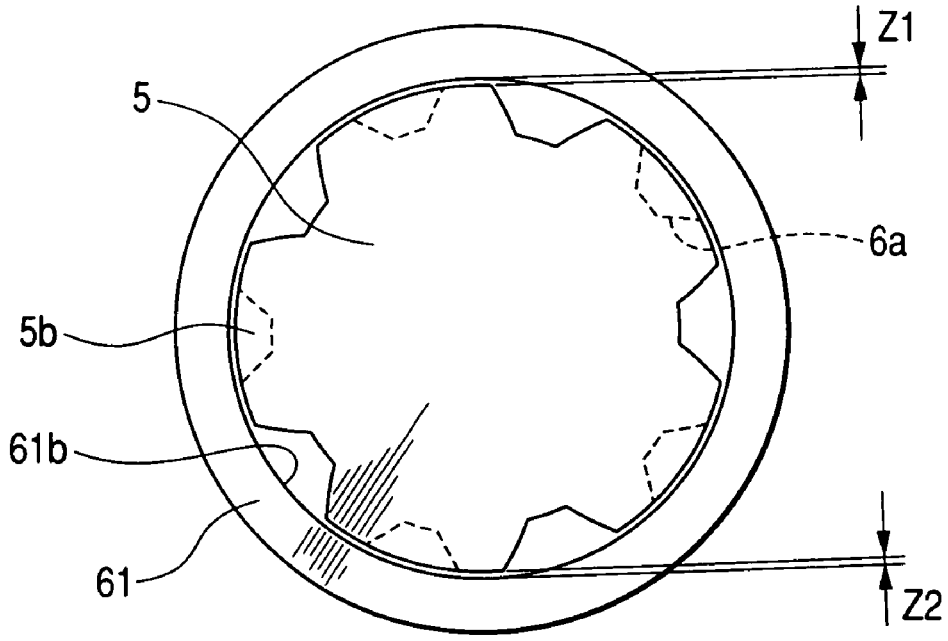
FIG. 4 is a cross-sectional view, taken on line C-C of FIG. 2, showing the relationship between a stopper and an inner bore.

Now, the dimensional relationships among the shaft splines 5*a*, the stoppers 5*b* and the barrel splines 61*a* and the inner bore 61*b* are described with reference to FIGS. 3 and 4.

A radial clearance X between the tooth top of each shaft spline 5*a* and a tooth bottom of each barrel spline 61*a* represents a difference between a tooth top diameter of the shaft spline 5*a* and a tooth bottom diameter of the barrel spline 61*a*. In particular, the radial clearance X represents a total value of a clearance X1 between a tooth, assuming a top position in FIG. 3, of each shaft spline 5*a* and a clearance X2 between a tooth, assuming a bottom position in FIG. 3, of each barrel spline 61*a*.

A backlash Y between each shaft spline sa and each barrel spline 61*a* represents a distance in play on a pitch circle between each shaft spline 5*a* and each barrel spline 61*a*. More particularly, the backlash Y represents a total value of a circumferential clearance Y1 between a tooth surface of each shaft spline 5*a* and a tooth surface of each barrel spline 61*a* in one rotational direction and a circumferential clearance Y2 between the tooth surface of each shaft spline 5*a* and the tooth surface of each barrel spline 61*a* in the other rotational direction as shown in FIG. 3.

Further, a radial clearance Z between an outer peripheral surface of each stopper 5*b* and an inner peripheral surface of the inner bore 61*b* represents a difference between an outer circumferential diameter of the stopper 5*b* and an inner peripheral diameter of the inner bore 61*b*. More particularly, the radial clearance Z represents a total value of a clearance Z1 between the protrusion, assuming a top position in FIG. 4, of each stopper 5*b* and the inner peripheral surface of the inner bore 61*b* and a clearance Z2 between the protrusion, assuming a bottom position in FIG. 4, of each stopper 5*b* and the inner peripheral surface of the inner bore 61*b*. Also, since the outer circumferential diameter of each stopper 5*b* and the tooth top diameter of each shaft spline 5*a* are identical to each other and the inner peripheral diameter of the inner bore 61*b* and the tooth bottom diameter of each barrel spline 61*a* are identical to each other, the radial clearance Z and the radial clearance X, described above, become identical to each other.

The radial clearance X between the tooth top of each shaft spline 5*a* and the tooth bottom of each barrel spline 61*a* and the radial clearance Z between the outer peripheral surface of each stopper 5*b* and the inner peripheral surface of the inner bore 61*b* are adjusted to be less than the backlash Y.

Now, description will be made of operation of the starter with such a structure mentioned above. As the ignition switch is turned on, the coil of the magnet switch 2 is supplied with electric current to cause the plunger of the magnet switch 2 to move in the retracting direction (rightward in FIG. 1). With the movement of such a plunger of the magnet switch 2, the lever 7 is caused to rotate in a direction shown in FIG. 1. Then, the overrunning clutch 6, connected to the other end of the lever 7, and the pinion gear 8 move in the forward drive direction (leftward in FIG. 1). This allows the pinion gear 8 to begin meshing with the ring gear 10 of the internal combustion engine.

As the overrunning clutch 6 and the pinion gear 8 further move in the forward drive direction, the pinion gear 8 is brought into deeply meshing engagement with the ring gear 10 and the forward ends of the barrel splines 61*a* are brought into abutting engagement with the stoppers 5*b*. With the splines 61*a* held in abutting engagement with the stoppers 5*b*, the overrunning clutch 6 and the pinion gear 8 stop moving in the axial direction. When this takes place, the stoppers 5*b* take a position in opposition to the inner bore 61*b* as shown in FIG. 2.

Consecutively, as the armature of the starter motor 3 rotates after the pinion gear 8 has been completely brought into meshing engagement with the ring gear 10 of the internal combustion engine, a drive power is delivered from the armature to the drive shaft 5 via the gear reduction unit 4. In addition, upon meshing engagement between the shaft splines 5*a* and the barrel splines 61*a*, the drive power, transferred to the drive shaft 5, is delivered to the overrunning clutch 6 and the pinion gear 8. With the rotation of the pinion gear 8, the ring gear 10 of the internal combustion engine is caused to rotate, permitting the internal combustion engine to start up. Also, under a situation where the drive power of the armature of the starter motor 3 is transferred to the pinion gear 8, the clutch outer 61 and the clutch inner 62 of the overrunning clutch 6 are brought into engagement with each other to act so as to transfer the rotation.

Subsequently, if an engine speed increases upon startup of the internal combustion engine, the pinion gear 8 is caused to rotate with the ring gear 10 of the internal combustion engine. As a rotational speed of the pinion gear 8 increases, the clutch inner 62 rotates faster than the clutch outer 62. This causes the clutch outer 61 and the clutch inner 62 to disengage from each other into a so-called overrunning condition. This causes the pinion gear 8 to move in the retracting direction, interrupting the armature of the starter motor 3 from rotating.

By the way, the operation has been mentioned above in connection with an exemplary case where the ignition switch is turned on and the ignition switch is turned off after the internal combustion engine has started up. In contrast, in cases where the ignition switch is turned on and the ignition switch is turned off before the internal combustion engine has started up, the starter operates in a manner described below.

In this case, the pinion gear 8 does not move in the retracting direction after the internal combustion engine has started up and the pinion gear 8 moves in the retracting direction before the internal combustion engine is started up, causing the pinion gear 8 to be brought into meshing engagement with the ring gear 10 of the internal combustion engine. Here, if the pinion gear 8 moves in the retracting direction to disengage from the rig gear 10 of the internal combustion engine, the pinion gear 8 continues rotating due to an inertia force of the armature or the like even if no electric power is supplied to the armature of the starter motor 3. During rotation of the pinion gear 8, if the ignition switch is turned on again, the pinion gear 8 is brought into meshing engagement with the ring gear 10 of the internal combustion engine. Then, this results in a tendency of causing the pinion gear 8 to rapidly stop rotating due to the ring gear 10 of the internal combustion engine in non-rotation. When this takes place, undue impacts occur between the shaft splines Sa and the barrel splines 61*a*.

With the occurrence of such undue impacts, the drive shaft 5 and the overrunning clutch 6 tend to incline with respect to each other. Here, the drive shaft 5 is rotatably supported in the housing 1 by means of the bearing 9*a*. That is, the drive shaft 5 is supported in the housing 1 by means of only the pinion gear 8 at one axial end thereof (facing the retracting direction). Accordingly, the drive shaft 5 takes a so-called cantilevered support structure with the shaft splines 5*a* taking free ends. Moreover, the overrunning clutch 6 is rotatably supported in the housing 1 by means of the bearing 9*d* and takes the form of a structure to rock about a center of the bearing 9*d*. Consequently, if undue impacts occur between the shaft splines 5*a* and the barrel splines 61*a*, then, the drive shaft 5 tends to incline about the center of the bearing 9*a*, causing the overrunning clutch 6 to incline about the center of the bearing 9*d*.

With the drive shaft 5 and the overrunning clutch 6 caused to incline with respect to each other in such a way, the tooth tops of the shaft splines 5*a* and the tooth bottoms of the barrel splines 61*a* are brought into contact with each other and the outer peripheral surface of each stopper 5*b* and the inner periphery of the inner bore 61*b* are brought into contact with each other, resulting in limited movement in inclinations of the drive shaft 5 and the overrunning clutch 6 with respect to each other.

In this configuration, since the backlash Y between each shaft spline 5*a* and each barrel spline 61*a* is greater than the radial clearance X between the tooth top of each shaft spline 5*a* and the tooth bottom of each barrel spline 61*a* and the radial clearance Z between the outer peripheral surface of each stopper 5*b* and the inner peripheral surface of the inner bore 61*b*, a tooth surface of each shaft spline 5*a* and a tooth surface of each barrel spline 61*a* are brought into contact with each other in a large surface area without contact in a local area. Especially, since the axial distance L1, by which relative inclining movements of the drive shaft 5 and the overrunning clutch 6 are restricted, is set to be greater than the meshing distance L2 between the shaft splines 5*a* and the barrel splines 61*a*, reliably suppressing the tooth surfaces of both the splines from being brought into local contact with each other.

That is, even if the drive shaft 5 and the overrunning clutch 6 are caused to incline with respect to each other, the tooth surfaces of the shaft splines 5*a* and the barrel splines 61*a* are held in contact with each other in an increased surface area, suppressing the occurrence of adhesion between both component parts.

Accordingly, in an event that the ignition switch is turned on again to cause the pinion gear 8 to be brought into mesh with the ring gear 10 of the internal combustion engine again, the drive power is reliably transferred from the armature of the starter motor 3 to the pinion gear 8, enabling the internal combustion engine to be started up.

In addition, axial forward ends of the shaft splines 5*a*, among meshing areas between the shaft splines 5*a* and the barrel splines 61*a*, assumes an intermediate position between the outer peripheral surfaces of the stoppers 5*b* and trailing ends of the meshing areas between both the splines. This prevents the both end portions of the shaft splines 5*a*, liable to bear stress concentration generally resulting from sags or sinks in form rolling, from encountering large stress, enabling adhesion to be prevented from occurring in sag and sink areas, caused in form rolling, of the distal ends of the shaft splines 5*a*.

Figure 5:
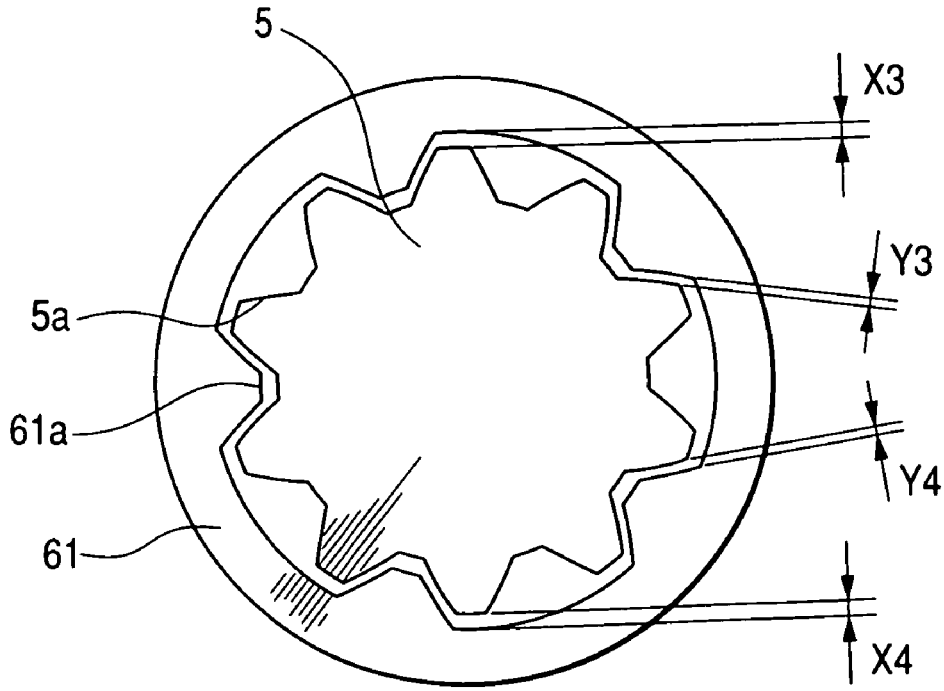
FIG. 5 is a cross sectional view, taken along a radial direction, of the related art starter with shaft splines and barrel splines shown in meshing engagement.

The above feature of the embodiment will now be explained in a comparative manner with the related art. Referring to FIG. 5, description is made of the relationship between the shaft splines 5*a* and the barrel splines 61*a* of the related art starter and description is made of a difference between the starter of the present embodiment and the starter of the related art. FIG. 5 is a view corresponding to FIG. 3.

As shown in FIG. 5, the radial clearance X between the tooth top of each shaft spline 5*a* and the tooth bottom of each barrel spline 61*a* represents a difference between the tooth top diameter of each shaft spline 5*a* and the tooth bottom diameter of each barrel spline 61*a*. More particularly, the radial clearance X represents a total value of a clearance X3 between a tooth, appearing in a top area in FIG. 5, of each shaft spline 5*a* and a clearance X4 between a tooth, appearing in a bottom area in FIG. 5, of each shaft spline 5*a* and the tooth bottom of each barrel spline 61*a*.

The backlash Y between each shaft spline 5*a* and each barrel spline 61*a* represents the distance in play on a pitch circle between each shaft spline 5*a* and each barrel spline 61*a*. More particularly, the backlash Y represents a total value of a circumferential clearance Y3 between a tooth surface of each shaft spline 5*a* in one rotational direction and a circumferential clearance Y4 between a tooth surface of each shaft splines 5*a* and a tooth surface of each barrel spline 61*a* on pitch circles of the shaft splines 5*a* and the barrel splines 61*a* as shown in FIG. 5.

The radial clearance X between the tooth top of each shaft spline 5*a* and the tooth bottom of each barrel spline 61*a* is greater than the backlash Y. In this case, if the drive shaft 5 and the overrunning clutch 6 are caused to incline with respect to each other, the tooth surface of each shaft spline 5*a* and the tooth surface of each barrel spline 61*a* are brought into contact with each other.

Consequently, if the ignition switch is turned on to cause the pinion gear 8 to be brought into meshing engagement with the ring gear 10 of the internal combustion engine again, the tooth surface of each shaft spline 5*a* and the tooth surface of each barrel spline 61*a* are brought into local contact with each other, resulting in fears of the occurrence of adhesion between both component parts. As a result, the drive power cannot be transferred from the armature of the starter motor 3 to the pinion gear 8, causing the occurrence of a risk of inability for the related art starter to start up the internal combustion engine.

On the contrary, with the starter of the present embodiment, the radial clearance between the tooth top of each shaft spline 5*a* and the tooth bottom of each barrel spline 61*a* is made less than the backlash between each shaft spline 5*a* and each barrel spline 61*a*. As a result, under circumstances where the drive shaft 5 and the overrunning clutch 6 tend to incline with respect to each other, the tooth top of each shaft spline 5*a* and the tooth bottom of each barrel spline 61*a* are brought into contact with each other. This makes it possible to prevent the drive shaft 5 and the plunger of the magnet switch 2 from inclining with respect to each other. As a result, the tooth top of each shaft spline 5*a* and the tooth bottom of each barrel spline 61*a* are brought into contact with each other in an increased contact surface area. Therefore, the tooth top of each shaft spline 5*a* and the tooth bottom of each barrel spline 61*a* are not involved in local contact, enabling adhesion to be prevented from occurring in the contact areas between both the splines.

The formation of the stoppers (axial travel stop member) 5*b* in the drive shaft 5 results in a status where the radial clearance between the stoppers 5*b* and the inner bore 61*b* is less than the backlash, providing advantageous effects as described below. In this case, the stoppers 5*b* and the inner bore 61*b* are effective in addition to the tooth tops of the shaft splines 5*a* and the tooth bottoms of the barrel splines 61*a* to suppress the movements of the drive shaft 5 and the overrunning clutch 6 tending to incline with respect to each other. This reliably enables an increase in a contact surface area between the tooth surfaces of the shaft splines 5*a* and the tooth surfaces of the barrel splines 61*a*, making it possible to prevent the occurrence of adhesion between contact areas of both splines.

With the barrel splines 61*a* formed in an axial distance greater than the meshing distance between the shaft splines 5*a* and the barrel splines 61*a*, the present invention has advantageous effects, as described below, when the forward ends of the barrel splines 61*a* are brought into abutting engagement with the stoppers 5*b*. In an event that the forward ends of the barrel splines 61*a* are brought into abutting engagement with the stoppers 5*b*, the starter operates such that the shaft splines 5*a* and the tooth surface of the barrel splines 61*a* are held in meshing engagement in a shortened distance. However, even if meshing engagement remains in the shortened distance, the presence of the axial distance greater than the meshing distance makes it possible to preclude the drive shaft 5 and the overrunning clutch 6 from inclining with respect to each other in a further reliable fashion.

Further, the presence of the stoppers 5*b* placed in a direction along which the barrel splines 61*a* are caused to axially move, results in advantageous effects as described below. In general, the shaft splines 5*a* are formed by rolling or the like and sags or sinks in form rolling are liable to occur in the both ends of the shaft splines 5*a* to cause stresses to be concentrated in leading end corner areas on the tooth surfaces of both ends of the shaft splines 5*a* with the resultant occurrence of adhesion.

However, with the drive shaft 5 and the overrunning clutch 6 restricted in inclining with respect to each other by outer peripheries of the stoppers 5*b* placed along the direction in which the barrel splines 61*a* are caused to axially move like the present invention, a large stress can be avoided from being applied to the both ends of the shaft splines 5*a* at areas formed with sags and sinks resulting upon form rolling. This is because of the reason that the inclining between the drive shaft 5 and the overrunning clutch 6 is restricted at two ends one of which includes a contact area between the stoppers 5*b* and the inner bore 61*b* and the other one of which includes a contact area between axial trailing ends of the barrel splines 61*a* and axially intermediate areas of the shaft splines 5*a*. Therefore, it becomes possible to avoid the occurrence of adhesion in the areas, formed with the sags and sinks caused in form rolling, on the distal ends of the shaft splines 5*a*.

Furthermore, with a tooth top diameter of the shaft splines 5*a* and an outer circumferential diameter of the stoppers 5*b* set to be substantially identical to each other, an advantageous effect is obtained as described below. Here, in cases where the shaft splines 5*a* are formed by rolling or the like, a need arises for grinding operation to be carried out for a radial clearance between a tooth top of each shaft spline 5*a* and a tooth bottom of each barrel spline 61*a* and a radial clearance between each stopper 5*b* and the inner bore 61*a* to be made less than a backlash. In such cases, with the tooth top diameter of the shaft splines and the outer circumferential diameter of the stoppers 5*b* being set to be substantially equal to each other, the shaft splines 5*a* and the barrel splines 61*a* can be formed by one grinding operation with the resultant reduction in working man-hour.

In addition, in cases where the drive shaft 5 is supported in the housing 1 under a cantilevered structure, the drive shaft 5 specifically has a risk of inclining with respect to the overrunning clutch 6 at an increased angle. Even in such cases, the present invention is able to restrict the drive shaft 5 and the overrunning clutch 6 from inclining with respect to each other.

By the way, while the present embodiment has been set forth above with reference to the starter wherein the drive shaft 5 has the so-called cantilevered support structure, the present invention is not limited to such a structure and may be implemented in a structure wherein the drive shaft 5 is rotatably supported in the housing 1 at both ends of the pinion gear 8. However, in a case where the drive shaft 5 has the so-called cantilevered support structure, the drive shaft 5 and the overrunning clutch 6 are caused to incline with respect to each other at an increased angle and, so, a great advantageous effect is obtained upon application of the present invention.

Additionally, while the present embodiment has been described in connection with an exemplary structure wherein the tooth top diameter of the shaft splines 5*a* and the outer circumferential diameter of the stoppers 5*b* are identical to each other, both factors may take different values. However, with both diameters being set to be identical to each other, working man-hour or the like may be decreased.

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A starter provided with a starter motor and formed to start up an internal combustion engine provided with a ring gear, comprising:

a drive shaft having an axial direction along which the drive shaft extends and a radial direction perpendicular to the axial direction and having an outer periphery formed with shaft splines formed for transmission of a drive power transmitted from the starter motor and stoppers protruding from the outer periphery in the axial direction, the stoppers being positionally closer to the ring gear than the shaft splines in the axial direction;

an overrunning clutch functioning as a one-way clutch and having an inner periphery wall formed by a bore, the drive shaft being inserted through the bore such that the overrunning clutch is movable with respect to the drive shaft in the axial direction and both the shaft splines and the stoppers are located in the bore, the inner periphery being formed with barrel splines engageable with the shaft splines of the drive shaft, the barrel splines having axial one ends operative to be brought into abutting engagement with the stoppers in the axial direction; and a pinion gear integrally disposed on the overrunning clutch to be brought into or out of meshing engagement with the ring gear of the internal combustion engine, wherein the shaft splines and the barrel splines are formed to have a first clearance between tooth tops of the shaft splines in the radial direction and tooth bottoms of the barrel splines in the radial direction and the first clearance is set to be less than a backlash caused between the shaft splines and the barrel splines; and the stoppers and the inner bore are formed to have a second clearance between the stoppers and the inner periphery wall sectioning the bore in the radial direction and the second clearance is set to be less than the backlash.

2. The starter according to claim 1, wherein when the axial one ends of the barrel splines are brought into abutting engagement with the stoppers, an axial distance from the stoppers to the axial other ends of the barrel splines which are among mutually meshed areas between the shaft splines and the barrel splines is set to be greater than a distance of the mutually meshed areas between the shaft splines and the barrel splines in the axial direction.

3. The starter according to claim 2, wherein the stoppers are formed to extend in the axial direction along which the overrunning clutch moves with respect to the barrel splines so as to allow the pinion gear to mesh with the ring gear.

4. The starter according to claim 3, wherein the tooth tops of the shaft splines have an axial diameter in the axial direction and the stoppers have an axial diameter in the axial direction, the axial diameters of both the tooth tops and the stoppers being substantially identical to each other.

5. The starter according to claim 4, wherein the drive shaft is rotatably supported by a support member which is either directly or indirectly fixed to a housing of the starter and integrally fixed to the housing, the support member being located on only one side of the pinion gear in the axial direction.

6. The starter according to claim 2, wherein the tooth tops of the shaft splines have an axial diameter in the axial direction and the stoppers have an axial diameter in the axial direction, the axial diameters of both the tooth tops and the stoppers being substantially identical to each other.

7. The starter according to claim 2, wherein the drive shaft is rotatably supported by a support member which is either directly or indirectly fixed to a housing of the starter and integrally fixed to the housing, the support member being located on only one side of the pinion gear in the axial direction.

8. The starter according to claim 1, wherein the stoppers are formed to extend in the axial direction along which the overrunning clutch moves with respect to the barrel splines so as to allow the pinion gear to mesh with the ring gear.

9. The starter according to claim 8, wherein the tooth tops of the shaft splines have an axial diameter in the axial direction and the stoppers have an axial diameter in the axial direction, the axial diameters of both the tooth tops and the stoppers being substantially identical to each other.

10. The starter according to claim 8, wherein the drive shaft is rotatably supported by a support member which is either directly or indirectly fixed to a housing of the starter and integrally fixed to the housing, the support member being located on only one side of the pinion gear in the axial direction.

11. The starter according to claim 1, wherein the tooth tops of the shaft splines have an axial diameter in the axial direction and the stoppers have an axial diameter in the axial direction, the axial diameters of both the tooth tops and the stoppers being substantially identical to each other.

12. The starter according to claim 1, wherein the drive shaft is rotatably supported by a support member which is either directly or indirectly fixed to a housing of the starter and integrally fixed to the housing, the support member being located on only one side of the pinion gear in the axial direction.

* * * * *